US009835183B2

(12) United States Patent
Weyer

(10) Patent No.: US 9,835,183 B2
(45) Date of Patent: Dec. 5, 2017

(54) ACTUATOR WITH CENTRAL TORQUE MEMBER

(71) Applicant: 1994 Weyer Family Limited Partnership, Enumclaw, WA (US)

(72) Inventor: Dean R. Weyer, Enumclaw, WA (US)

(73) Assignee: 1994 Weyer Family Limited Partnership, Enumclaw, WA (US)

( * ) Notice: Subject to any disclaimer, the term of this patent is extended or adjusted under 35 U.S.C. 154(b) by 333 days.

(21) Appl. No.: 14/582,001

(22) Filed: Dec. 23, 2014

(65) Prior Publication Data

US 2016/0177979 A1 Jun. 23, 2016

(51) Int. Cl.
*F01B 3/00* (2006.01)
*F15B 15/06* (2006.01)

(52) U.S. Cl.
CPC ..... *F15B 15/06* (2013.01); *F15B 15/068* (2013.01)

(58) Field of Classification Search
CPC ..... F15B 15/06; F15B 15/068
USPC ..... 92/33, 136
See application file for complete search history.

(56) References Cited

U.S. PATENT DOCUMENTS 2,948,263 A 8/1960 Royer
2,959,064 A 11/1960 Geyer et al.
3,339,463 A 9/1967 Updegrave
4,373,426 A 2/1983 Weyer
4,422,366 A 12/1983 Weyer
4,741,250 A * 5/1988 Weyer ..... F15B 15/068 92/33
5,241,895 A 9/1993 Weyer
5,447,095 A * 9/1995 Weyer ..... F15B 15/068 92/136
6,247,390 B1 * 6/2001 Busch ..... F15B 15/068 92/33
7,267,044 B1 9/2007 Klinger

FOREIGN PATENT DOCUMENTS

WO 99/000603 A1 1/1999

* cited by examiner

*Primary Examiner* — Michael Leslie
(74) *Attorney, Agent, or Firm* — George C. Rondeau, Jr.; Davis Wright Tremaine LLP

(57) ABSTRACT

A fluid-powered rotary actuator having a body with a shaft disposed therein and having a linear-to-rotary force-converting member mounted for longitudinal movement within said body in response to the selective application of pressurized fluid thereto. The actuator uses a torque member having a flange portion attached to the body or an external structure and a grooved central portion. A piston sleeve has outward grooves meshing with inward grooves on the shaft and inward grooves for meshing with outward grooves on the torque member central portion. The body sidewall is not used as a torque transmission surface during fluid-powered operation of the actuator.

28 Claims, 9 Drawing Sheets

ACTUATOR WITH CENTRAL TORQUE MEMBER

BACKGROUND OF THE INVENTION

Field of the Invention

The present invention relates generally to actuators, and more particularly, to fluid-powered rotary actuators in which axial movement of a piston results in relative rotational movement between a body and a shaft.

Description of the Related Art

Rotary helical splined actuators have been employed in the past to achieve the advantage of high-torque output from a simple linear piston-and-cylinder drive arrangement. The actuator typically uses a cylindrical body with an elongated rotary shaft extending coaxially within the body, with an end portion of the shaft typically providing rotational output drive and the body held stationary, although in some applications the rotational output drive may be provided by the body with the shaft held stationary. An elongated annular piston sleeve has a sleeve portion splined to cooperate with corresponding splines on the inward wall of the body sidewall and on the outward wall of the shaft. The splines may be formed directly on the inward wall of the body sidewall or one a ring gear formed on or connected to the body sidewall. The piston sleeve is reciprocally mounted within the body and has a piston head portion for the application of fluid pressure to one or the other opposing sides thereof to produce axial movement of the piston sleeve.

As the piston sleeve linearly reciprocates in an axial direction within the body, outer helical splines of the sleeve portion engage helical splines on the inward wall of the body sidewall to cause rotation of the sleeve portion. The resulting linear and rotational movement of the sleeve portion is transmitted through inner helical splines of the sleeve portion to helical splines on the outward wall of the shaft to cause the shaft to rotate relative to the body. Bearings are typically supplied to rotatably support one or both ends of the shaft relative to the body.

Reducing the length and weight of fluid-powered rotary actuators and increasing their durability are an almost always present challenge. As is reducing the cost of the actuator.

It will be therefore be appreciated that there has long been a significant need for fluid-powered actuators that have a reduced length and are lighter in weight, and are less expensive to manufacture. The present invention fulfills these needs and further provides other related advantages.

BRIEF DESCRIPTION OF THE SEVERAL VIEWS OF THE DRAWING(S)

DETAILED DESCRIPTION OF THE INVENTION

Figure 1:
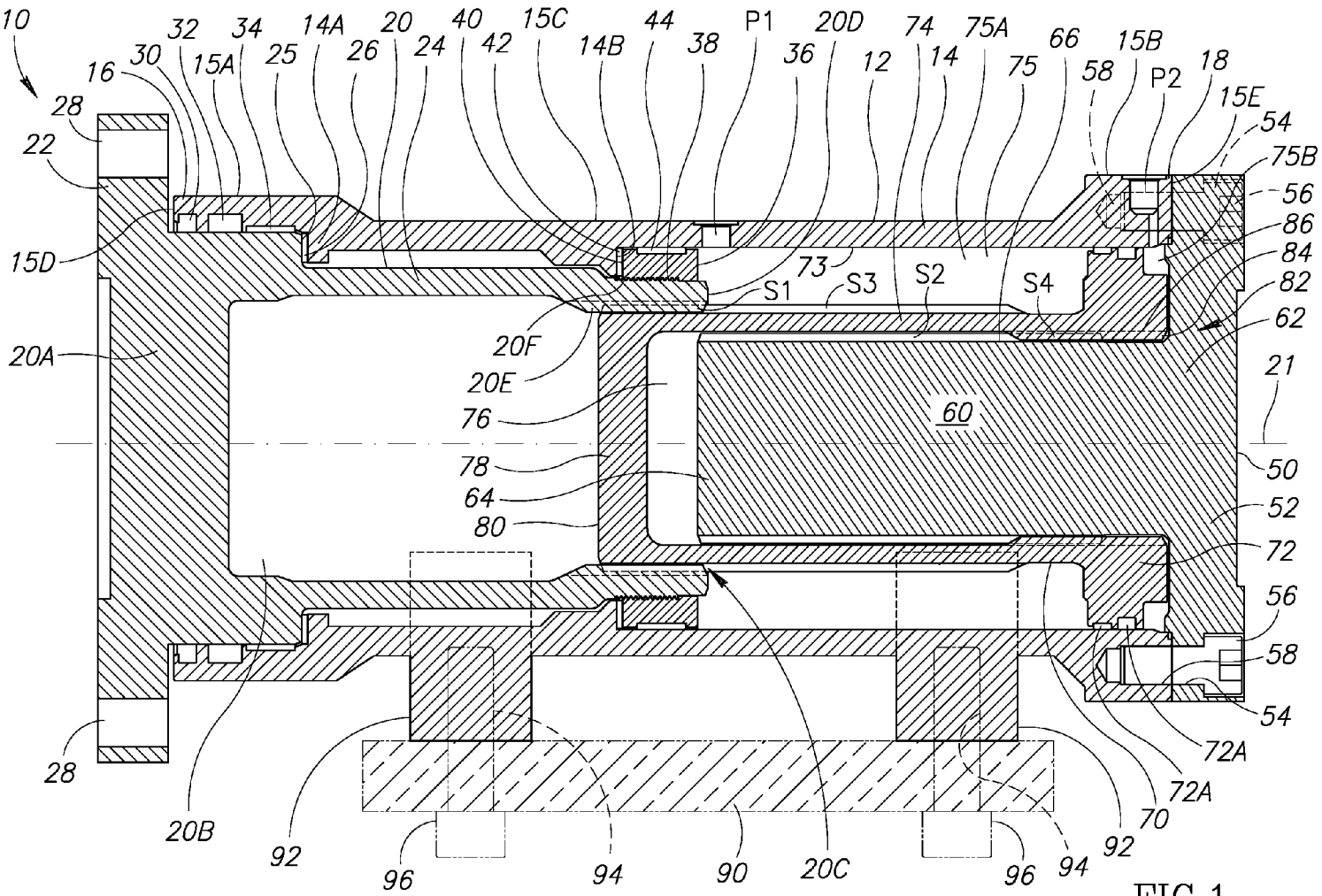
FIG. 1 is a cross-sectional side elevational view of a fluid-powered rotary actuator embodying the present invention, shown taken substantially along the line A-A of FIG. 2.
Figure 2:
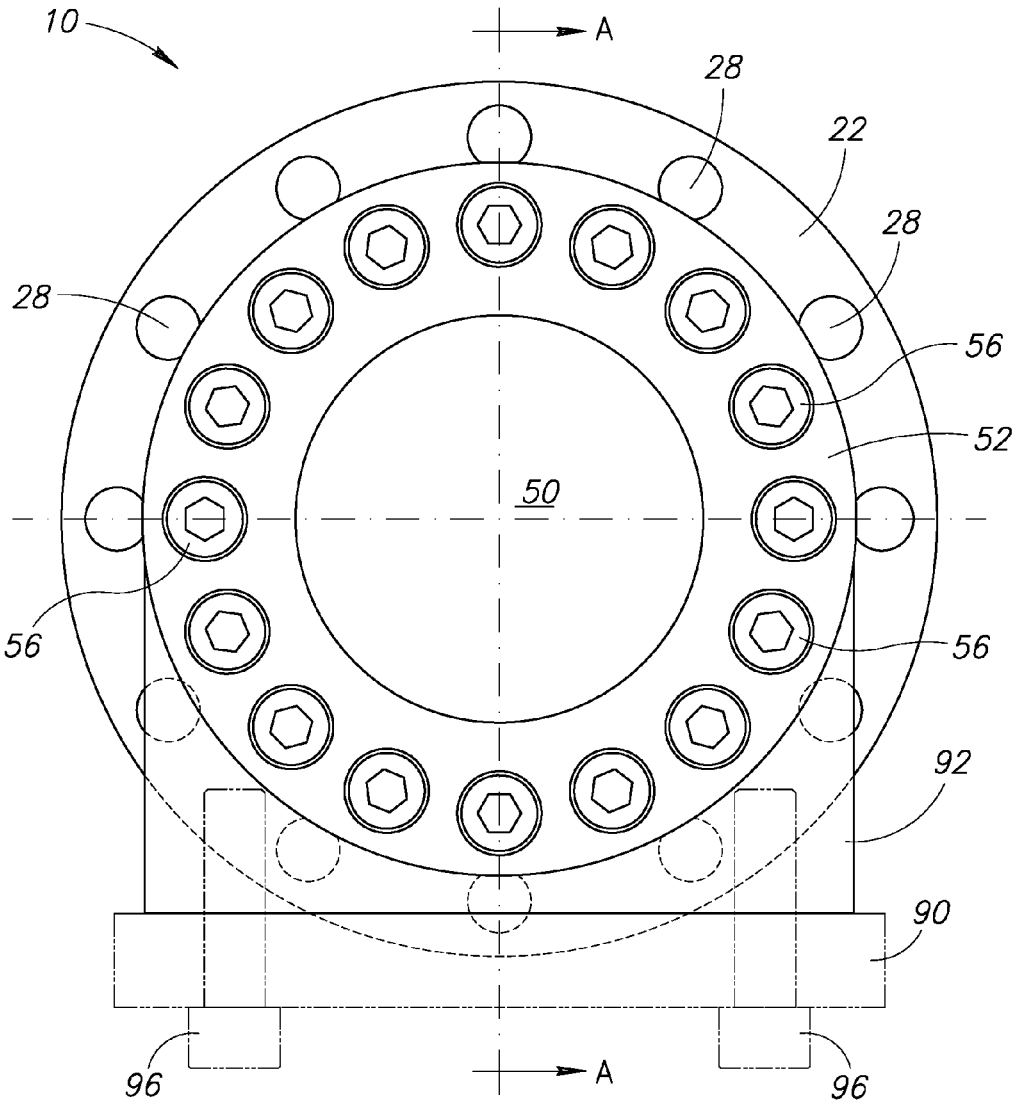
FIG. 2 is an end elevational view of the actuator of FIG. 1.

As shown in the drawings for purposes of illustration, a first embodiment of the invention is embodied in a fluid-powered rotary actuator 10 is shown in FIGS. 1 and 2. The rotary actuator 10 has an elongated housing or body 12 with a body sidewall 14 and first and second body ends 16 and 18, respectively. The body sidewall 14 has a first body end sidewall portion 15A toward the first body end 16, a second body end sidewall portion 15B toward the second body end 18, and a mid-body sidewall portion 15C located about midway between the first and second body ends 16 and 18.

A circumferentially extending first body shoulder 14A of the body sidewall 14 is located axially inward from the first body end 16 at the first body end sidewall portion 15A, and is axially outward facing toward the first body end 16. A circumferentially extending second body shoulder 14B of the body sidewall 14 is located axially inward from the first body end 16 at the mid-body sidewall portion 15C, and is axially facing toward the second body end 18. The body further includes an axially outward circumferentially extending first body end wall 15D located at the first body end 16 and an axially outward circumferentially extending second body end wall 15E located at the second body end 18.

A rotary drive or output shaft 20 is coaxially positioned at least partially within the body 12 and supported for rotation relative to the body about a longitudinal axis 21 of the body sidewall 14. The shaft 20 has a shaft first end portion 20A located toward the first body end 16 and the first body sidewall portion 15A, with a circumferentially extending shaft flange portion 22 positioned axially outward of the body 12 at the first body end and extending radially outward of an inward portion of the body sidewall portion 15A. The shaft 20 has an elongated shaft portion 24 coaxially positioned within the body 12 and having an open ended cylindrical in cross-section shape, interior chamber 20B with an opening 20C at its end toward the second body end 18. The shaft portion 24 extends from the shaft flange portion 22 at the first body end 16 partially along length of the body 12 toward the second body end 18, and terminates at the mid-body sidewall portion 15C, whereat an annular shaft second end portion 20D is located and defines the opening 20C. The shaft second end portion 20D has an inward annular wall portion 20E with inward grooves, illustrated as splines S1, extending over at least a portion of its longitudinal length.

A circumferentially extending shoulder 25 of the shaft portion 24 at the shaft first end portion 20A is located axially inward from the first body end 16, and is axially inward facing toward the second body end 18. The shoulder 25 is in face-to-face juxtaposition with the first body end shoulder 14A, with a circumferentially extending thrust bearing 26 positioned therebetween to limit axial movement of the shaft 20 toward the second body end 18.

The shaft flange portion 22 has a plurality of circumferentially arranged apertures 28 (only two being illustrated in FIG. 1) for attaching the shaft 20 to a structure (not shown) to which the rotational drive of the actuator 10 is to be transmitted by the powered rotation of the shaft, such as by using bolts (not shown).

An exclusion seal 30 and a pressure seal 32 are disposed between the periphery of the shaft first end portion 20A and the first body end sidewall portion 15A to provide a fluid-tight seal and containment seal therebetween. It is noted that each of the seals 30 and 32 is positioned in a circumferentially extending groove in the inward wall of the first body end sidewall portion 15A; however, as shown in a subsequently described embodiment (see FIG. 5), the grooves for the seals 30 and 32 may alternatively be provided in the outward wall of the shaft first end portion 20A. A bearing 34 is positioned between the shaft first end portion 20A and the first body end sidewall portion 15A, in the area between the pressure seal 32 and the first body end shoulder 14A, to facilitate sliding rotary motion and radial load transfer between the shaft first end portion 20A and the first body end sidewall portion 15A.

The shaft second end portion 20D has a threaded outward annular wall portion 20F. The shaft 20 includes a ring member 36 with a threaded inward annular wall portion 38 which is threadably received on the threaded outward annular wall portion 20F of the shaft second end portion 20D. The ring member 36 is mounted to the shaft second end portion 20D for rotational movement therewith as the shaft 20 rotates during fluid-powered operation of the actuator 10. The ring member 36 has a circumferentially extending shoulder 40 axially facing toward the first body end 16, and located in face-to-face juxtaposition with second body shoulder 14B, with a circumferentially extending thrust bearing 42 therebetween to limit axial movement of the shaft 20 toward the first body end 16. In an alternative embodiment not illustrated, the ring member 36 may be formed as an integral portion of the shaft 20, or be attached to the shaft second end portion 20D by other than a threaded connection such as by threaded fasteners, pins or retaining rings. A bearing 44 is positioned between the ring member 36 and the mid-body sidewall portion 15C to facilitate sliding rotary motion and radial load transfer between the ring member 36 of the shaft 20 and the mid-body sidewall portion 15C.

The actuator 10 further includes a torque member 50. The torque member 50 has a circumferentially extending torque member flange portion 52, an end flange, positioned axially outward of the body 12 at the second body end 18. The torque member flange portion 52 has a plurality of circumferentially arranged apertures 54 (only two being illustrated in FIG. 1) for attaching the torque member 50 to the body 12. A plurality of bolts 56 extend through the apertures 54 and are each threadably received in one of a plurality of circumferentially arranged apertures 58 in the second body end wall 15E located at the second body end 18, which are arranged to correspond in position with the apertures 54 in the torque member flange portion 52. The bolts 56 prevent rotational movement and axial movement of the torque member flange portion 52 relative to the body 12 during fluid-powered operation of the actuator 10. It is noted that the torque member flange portion 52 in alternative embodiments not shown may be welded, pinned or otherwise attached to the second body end sidewall portion 15B toward the second body end 18.

The torque member 50 further has an elongated torque member central portion 60 coaxially positioned within the body 12 with a fixed end portion 62 attached to the torque member flange portion 52 at the second body end 18. The torque member flange portion 52 serves as a connection member connecting the torque member central portion 60 and hence the torque member 50 to the body 12 at the second body end 18, as described above. The torque member central portion 60 extends partially along the longitudinal axis 21 of the body sidewall 14 toward the first body end 16, from the torque member flange portion 52 at the second body end 18, partially along the length of the body toward the first body end 16, and terminates at about the mid-body sidewall portion 15C and the inward end of the shaft second end portion 20D, whereat a free end portion 64 is located. The torque member central portion 60 has an outward wall portion 66 with outward grooves, illustrated as splines S2, extending over at least a substantial portion of its axial length.

The torque member flange portion 52 and the torque member central portion 60 are formed as an integral portion of the torque member 50. Since the torque member flange portion 52 is attached to the body 12 in a manner to prevent rotational movement and axial movement of the torque member flange portion relative to the body 12 during fluid-powered operation of the actuator 10, the attachment of the torque central member portion 60 to the torque member flange portion 52 prevents rotational movement and axial movement of the torque member central portion 60 relative to the body 12 during fluid-powered operation of the actuator 10. In an alternative embodiment not illustrated, the torque member flange portion 52 and the torque member central portion 60 may be formed as separate parts connected together in a manner to prevent rotational movement and axial movement of the torque member central portion 60 relative to the body 12 during fluid-powered operation of the actuator 10.

The actuator 10 has an annular force-converting piston sleeve 70 coaxially and reciprocally mounted within the body 12 coaxially with the shaft 20 for movement from a first end position toward the first body end 16 and a second end position toward the second body end 18. The piston sleeve 70 has an annular piston head portion 72 toward the second body end 18 and an annular sleeve portion 74 rigidly attached to the piston head portion and extending therefrom toward the first body end 16. The piston head portion 72 carries seals 72A to provide a fluid tight seal between the piston head portion and an inward wall 73 of an annular chamber 75 of the body 12 toward the second body end 18 within which the piston head portion 72 reciprocates as the piston sleeve 70 reciprocates between its first end position and second end position during fluid-powered operation of the actuator. The piston sleeve 70 has an elongated cylindrical in cross-section shape, interior piston sleeve chamber 76 positioned therewithin in coaxial alignment with the axis 21 of the body sidewall 14. The interior piston sleeve chamber 76 has a closed end wall 78 at an end 80 toward the first body end 16, and an opening 82 at an end 84 toward the second body end 18, which provides the opening 82 in the axially outward end of the piston head portion 72.

The sleeve portion 74 of the piston sleeve 70 is sized to extend through the opening 20C of the shaft portion 24 of the shaft 20 and into the interior chamber 20B of the shaft portion 24. The sleeve portion 74 has outward grooves, illustrated as splines S3, extending over at least a substantial portion of its axial length which slidably mesh with the inward splines S1 of the annular shaft second end portion 20D of the shaft 20 as the piston sleeve 70 reciprocates between its first end position and second end position during fluid-powered operation of the actuator.

The elongated torque member central portion 60 is sized to extend through the opening 82 in the piston head portion 72 of the piston sleeve 70 and into the interior piston sleeve chamber 76 of the piston sleeve. The piston sleeve chamber 76 has an inward wall 86 with inward grooves, illustrated as splines S4, extending over at least a portion of its axial length toward the second body 18 which slidably mesh with outward splines S2 of the torque member central portion 60 as the piston sleeve 70 reciprocates between its first end position and second end position during fluid-powered operation of the actuator.

In the illustrated embodiment of FIG. 1, the first set of inter-meshing splines S1 and S3 are helical with the same slope, and the second set of inter-meshing splines S2 and S4 are helical with the same slope, although the slopes of the first and second sets need not be the same and it is customary for the first set to be of opposite hand than the second set. Further, both of the first and second sets on inter-meshing splines need not be helical and in some instances the one set is straight and the other is helical. It should be understood that while splines are shown in the drawings and described herein, the principle of the invention is applicable to any form of linear-to-rotary motion conversion means, such as balls or rollers, or other means such as where the shaft second end portion 20D of the shaft 20 and the sleeve portion 74 have cooperating torque transmission surfaces and the torque member central portion 60 and the inward wall 86 of the piston sleeve chamber 76 have cooperating torque transmission surfaces which transform axial motion of the piston sleeve 70 into relative rotational movement between the body 12 and the shaft 20. The torque transmission surfaces may be non-circular cross-sectional shapes.

The body 12 of the actuator 10 may be mounted to another structure 90 in a variety of manners. In the illustrated embodiment of FIG. 1, the body 12 has mounting projections 92 with threaded apertures 94 which receive bolts 96 to fasten the body 12 to the structure 90.

As will be readily understood, reciprocation of the piston head portion 72 within the annular chamber 75 of the body 12 as the piston sleeve 70 reciprocates between its first end position and second end position during fluid-powered operation of the actuator, occurs when hydraulic fluid, such as oil, air or any other suitable fluid, under pressure selectively enters through one or the other of a first port P1 extending through the mid-body sidewall portion 15C which is in fluid communication with a fluid-tight compartment portion 75A of the annular chamber 75 to a side of the piston head portion toward the first body end 16, or through a second port P2 extending through the second body end sidewall portion 15B which is in fluid communication with a fluid-tight compartment portion 75B of the annular chamber 75 to a side of the piston head portion toward the second body end 18. As the piston head portion 72 linearly reciprocates in an axial direction within the body 12, the inward helical splines S4 of the piston sleeve chamber 76 engage or mesh with the outward helical splines S2 of the torque member central portion 60 to cause rotation of the piston sleeve 70. Since the torque member central portion 60 is prevented from rotating relative to the body 12 during fluid-powered operation of the actuator 10, as described above, the linear and rotational movement of the piston sleeve 70 is transmitted through the outward helical splines S3 of the sleeve portion 74 of the piston sleeve to the inward helical splines S1 of the annular shaft second end portion 20D of shaft 20 to cause the shaft 20 to rotate. The smooth inward wall 73 of the annular chamber 75 has sufficient axial length to accommodate the full end-to-end reciprocating stroke travel of the piston head portion 72 to allow reciprocation of the piston sleeve 70 between its first end position and second end position during fluid-powered operation of the actuator. Axial movement of the shaft 20 is restricted, as described above, so the shaft cannot move in the axial direction. As such, all axial movement of the piston sleeve 70 is converted into rotational movement of the shaft 20. Depending on the slope and direction of turn of the various helical splines, there may be provided a summing of the rotary output of the shaft 20.

The application of fluid pressure to the first port P1 produces axial movement of the piston sleeve 70 toward the second body end 18. The application of fluid pressure to the second port P2 produces axial movement of the piston sleeve 70 toward the first body end 16. The rotary actuator 10 provides relative rotational movement between the body 12 and shaft 20 through the conversion of linear movement of the piston sleeve 70 into rotational movement of the shaft, in a manner well known in the art. The shaft 20 is selectively rotated by the application of fluid pressure to one or the other of the first port P1 or the second port P2, and the rotation is transmitted to the structure (not shown) to which the shaft flange portion 22 is attached. If the shaft flange portion 22 is attached to a stationary structure, then the mounting projections 92 of the body 12 may be attached to the structure 90 for the body to transmit the rotational force of the actuator 10 to the structure 90. When hydraulic fluid under pressure is applied to the first port P1 the piston head portion 72 will move axially within the annular chamber 75 toward the second body end 18 and produce one of clockwise or counterclockwise rotation of the shaft 20, and when hydraulic fluid under pressure is applied to the second port P2 the piston head portion 72 will move axially within the annular chamber 75 toward the first body end 16 and produce the other of clockwise or counterclockwise rotation of the shaft 20.

While the piston sleeve 70 is described as having a piston sleeve, the effective piston head surface area is the full circular area with a diameter equal to the diameter of the interior bore of the body 12 wherein the piston head portion 72 reciprocates. This is because the shaft 20 does not extend through the piston sleeve 70, either the piston head portion 72 or the closed end wall 78 of the interior piston sleeve chamber 76, and the torque member central portion 60 does not extend through the closed end wall 78, hence the effective piston head surface area is not limited as in actuators where the shaft passes through the piston sleeve and hence reduces the effective piston head surface area to which pressurized hydraulic fluid is applied when applied through either the first or second ports P1 or P2.

It is noted that with conventional rotary actuators the piston sleeve has a sleeve portion splined to cooperate with corresponding splines formed directly on the inward wall of the body sidewall or on a ring gear directly connected to the inward wall of the body sidewall, and transmits all the operating torque to a portion of the body sidewall at an intermediate location between the opposite ends of the body as the piston sleeve reciprocates between its first end position and second end position during fluid-powered operation of the actuator. Whereas with the present invention using the torque member 50, the operating torque of the actuator 10 is transmitted during fluid-powered operation of the actuator by the piston sleeve portion 74 of the piston sleeve 70 to the rather stout torque member central portion 60 located on the axis 21 of the actuator, interior of the annular piston sleeve, and transfers that torque via the torque member flange 52 to the second body end 18 of the body, rather than to the surface of the mid-body sidewall portion 15C. This eliminates the body torque transmission surface from the bore of actuator body and allows restraining of the axial movement of the shaft without a large diameter shaft which extends out both ends of the body, thus reducing the mass and increasing the area for the pressurized fluid to act on the piston head portion of the piston sleeve. It also allows a shaft mounting flange which extends outward of the body. This configuration enables a shorter and lighter actuator to be constructed to provide a short, light and cost effective product having a shaft mounting surface which extends outward of the body interior at the first body end 16.

It is further noted that the radial location of the transmission of torque between the splines S4 of the sleeve portion 74 and the splines S2 of the torque member 50 is located radially inward from the radial location of the transmission of the torque between the splines S3 of the sleeve portion 74 and the splines S1 of the shaft 20.

Figure 3:
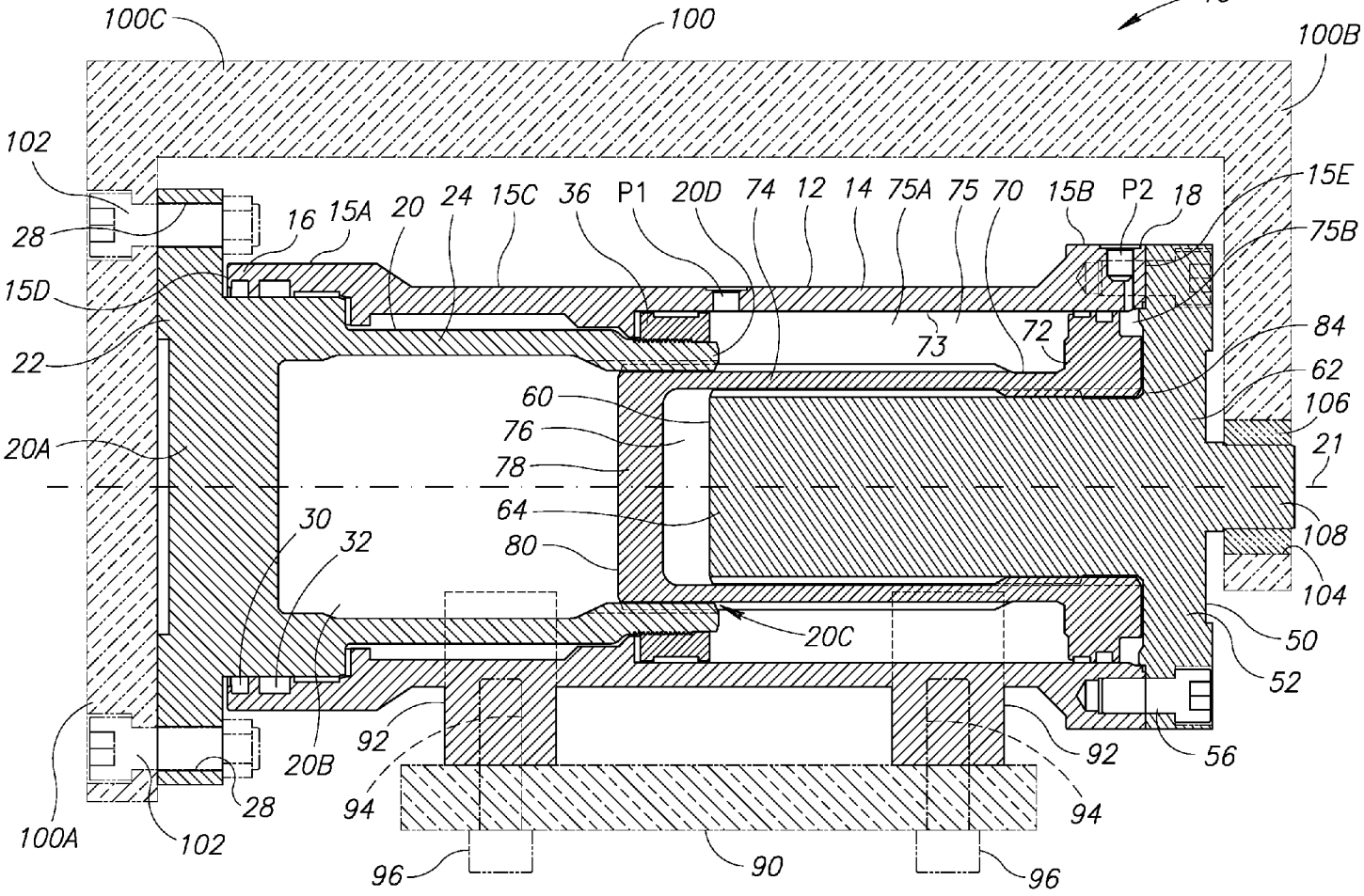
FIG. 3 is a cross-sectional side elevational view of a second embodiment of the fluid-powered rotary actuator of FIG. 1.

A second embodiment of the fluid-powered rotary actuator 10 of the present invention is shown in FIG. 3. The actuator of this second embodiment has substantially the same basic design as the first embodiment so only the more significant difference will be described and the same reference numbering will be used for the same or similar component of the actuator.

The actuator 10 of this second embodiment is shown attached to a saddle or "C"-shaped attachment frame 100, which is positioned outward of the body 12. The attachment frame 100 has a first end leg 100A at the first body end 16 and a second end leg 100B at the second body end 18, with a mid-portion member 100C spanning between the first and second end legs. The first end leg 100A is rigidly attached to the shaft flange portion 22 at the first body end 16 for rotation with the shaft 20 relative to the body 12, with the first end leg being spaced axially apart from the first body end. The first end leg 100A abuts against an outward end face of the shaft flange portion 22 and is bolted thereto by a plurality of circumferentially arranged bolts 102 (only two being illustrated in FIG. 3) which extend through the apertures 28.

The attachment frame 100 is used to transmit the rotational drive of the actuator 10 to a structure (not shown) to which the attachment frame is connected or of which the attachment frame is an integral part. The attachment frame 100 has the rotational drive of the shaft 20 transmitted thereto so as to provide the torque needed, e.g., to a mining drill mounting platform (or another tool) for tilting the drill (or other tool) to which the attachment frame is connected to a desired lateral tilt angle and holding the drill (or other tool) in that position while the drill (or other tool) performs the desired work. The attachment frame 100 is limited in axial movement relative to the body 12.

The first end leg 100A and the second end leg 100B of the attachment frame 100 extend radially beyond the body sidewall 14 and the mid-portion member 100C extends between the first and second end legs and is rigidly attached to both, and extends generally parallel to the body sidewall 14 at a position spaced away from the body sidewall. The mid-portion member 100C of the attachment frame 100 is configured to be rigidly attached to the structure to which the rotational drive of the actuator 10 is to be transmitted.

The second end leg 100B of the attachment frame 100 is axially spaced apart outward of the torque member flange portion 52, and has an aperture 104 within which is a bearing 106. In this second embodiment of the actuator 10, the torque member 50 further includes a stub shaft 108 attached to the torque member flange portion 52 and projecting axially outward in coaxial alignment with the axis 21 of the body sidewall 14. The stub shaft 108 is rotatably supported by the bearing 106 such that the second end leg 100B of the attachment frame 100 rotates freely relative to the torque member 50 but yet is supported by the torque member.

Figure 4:
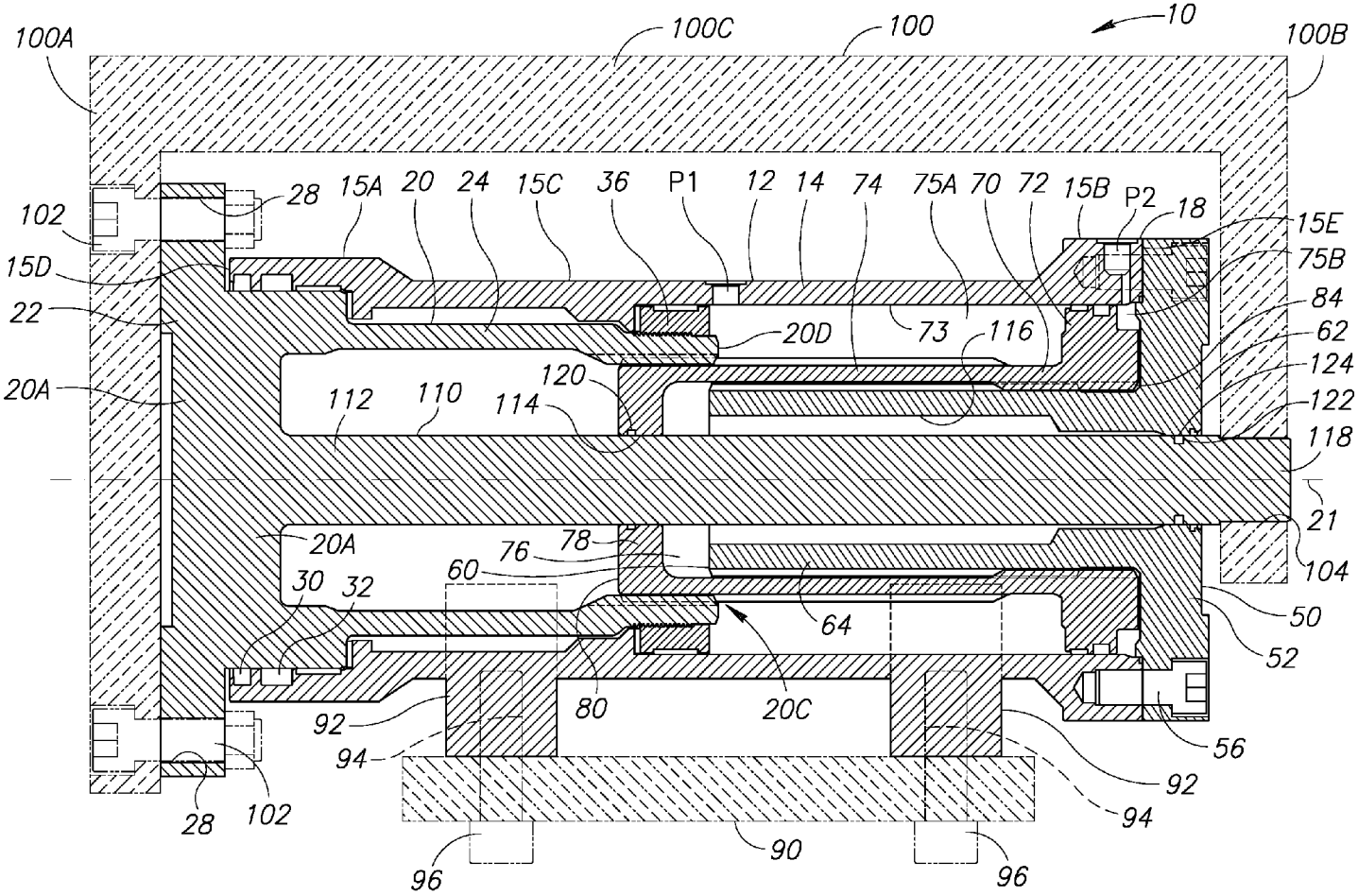
FIG. 4 is a cross-sectional side elevational view of a third embodiment of the fluid-powered rotary actuator of FIG. 1.

A third embodiment of the fluid-powered rotary actuator 10 of the present invention is shown in FIG. 4. The actuator of this third embodiment has substantially the same basic design as the first and second embodiments so only the more significant difference will be described and the same reference numbering will be used for the same or similar component of the actuator.

The shaft 20 of the actuator 10 of the this third embodiment includes a central shaft member or shaft rod 110 in coaxial alignment with the axis 21 of the body sidewall 14. A rod first end portion 112 of the rod 110 is connected to an axially inward end of the shaft first end portion 20A at the first body end 16 for rotation with the shaft first end portion 20A, and extends coaxially within the body 12 toward the second body end 18 through an aperture 114 in the end wall 78 of the interior piston sleeve chamber 76 and through an axially extending open ended interior chamber 116 of the torque member 50, and terminates in a rod second end portion 118 positioned axially outward beyond the torque member flange portion 52. The rod 110 is rotatably disposed in the aperture 114 in the end wall 78 of the interior piston sleeve chamber 76 and in the interior chamber 116 of the torque member 50, and rotates freely relative to both. Seals 120 and 122 are provided, respectively, to prevent passage of fluid between the rod 110 and the aperture 114 and an exit opening 124 of the interior piston sleeve chamber 76 in the torque member flange portion 52.

The rod second end portion 118 is received in the aperture 104 of the second end leg 100B of the attachment frame 100. In this embodiment the rod second end portion 118 rotates with the second end leg 1108 and also is supported by the torque member flange portion 52 of the torque member 50.

Figure 5:
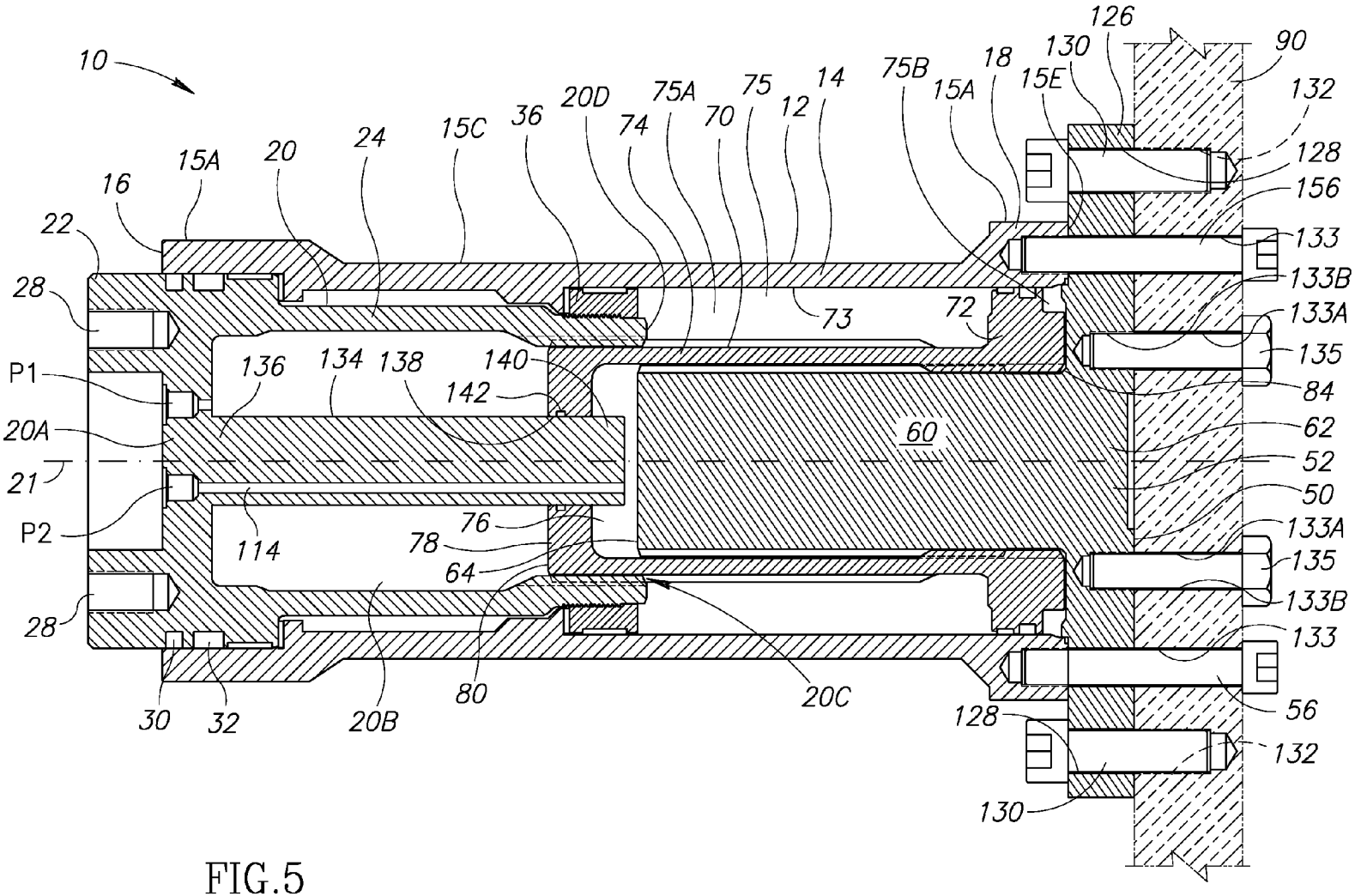
FIG. 5 is a cross-sectional side elevational view of a fourth embodiment of the fluid-powered rotary actuator of FIG. 1.
Figure 6:
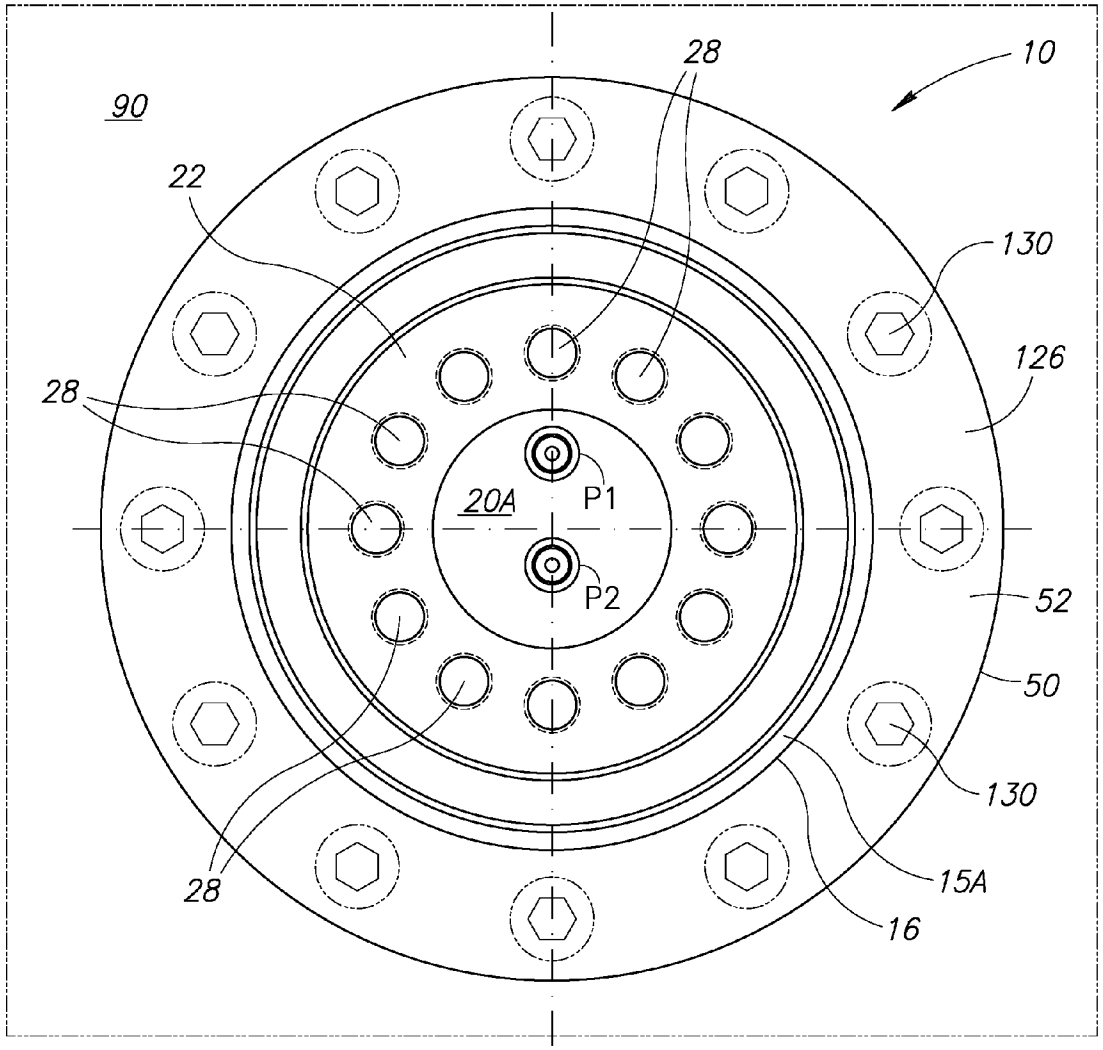
FIG. 6 is an end elevational view of the actuator of FIG. 5.
Figure 7:
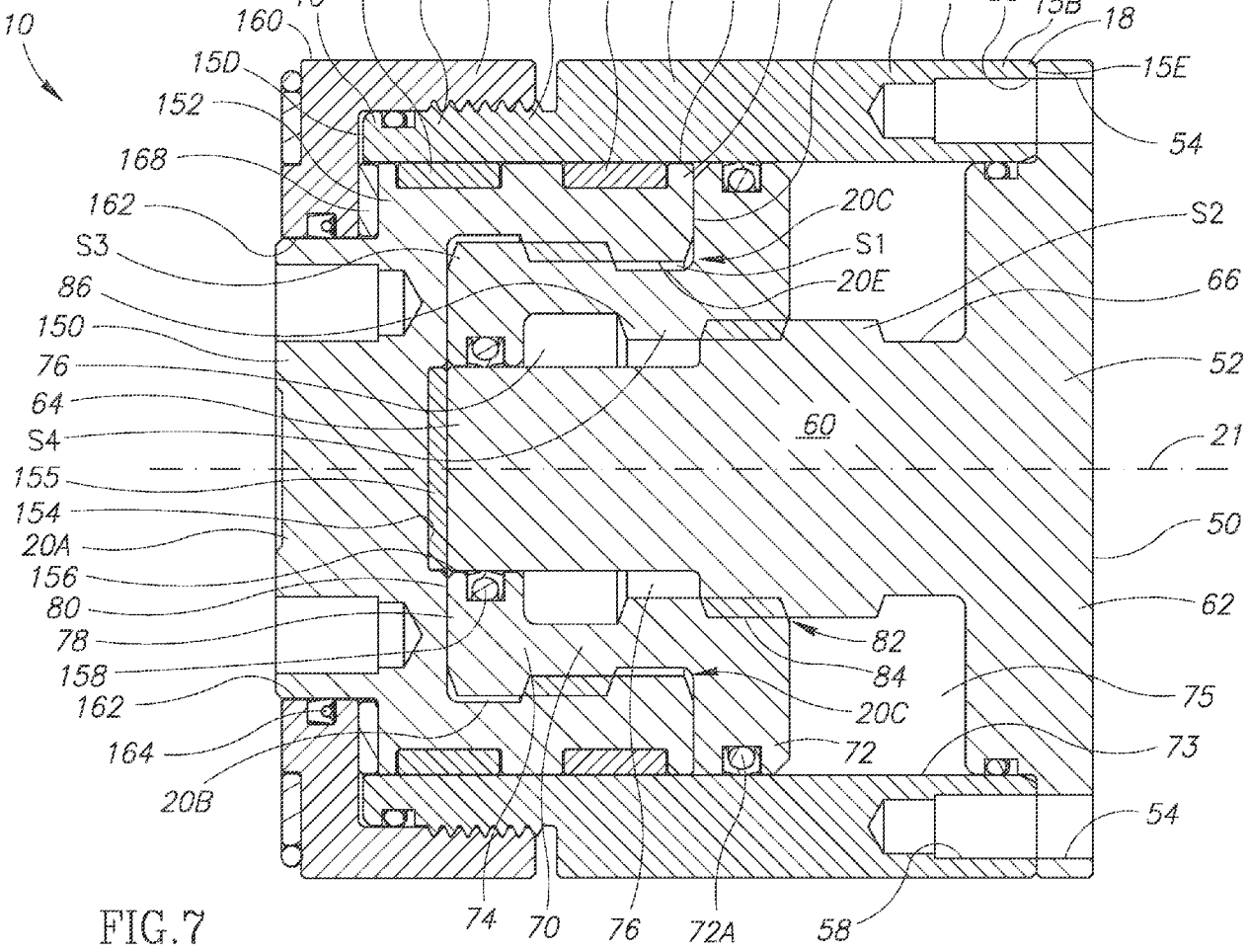
FIG. 7 is a cross-sectional side elevational view of a fifth embodiment of the fluid-powered rotary actuator of FIG. 1.
Figure 8:
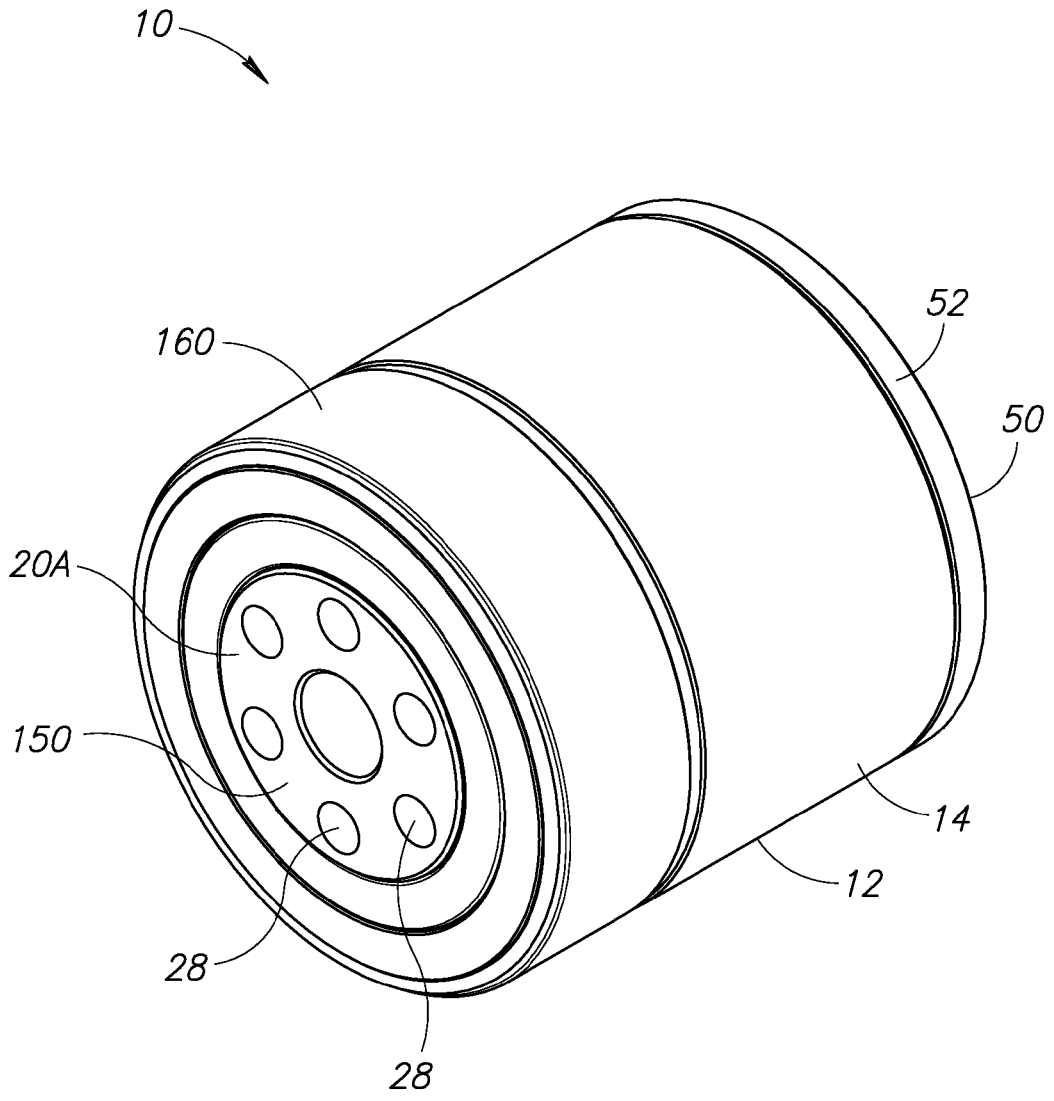
FIG. 8 is a perspective view of the actuator of FIG. 7.
Figure 9:
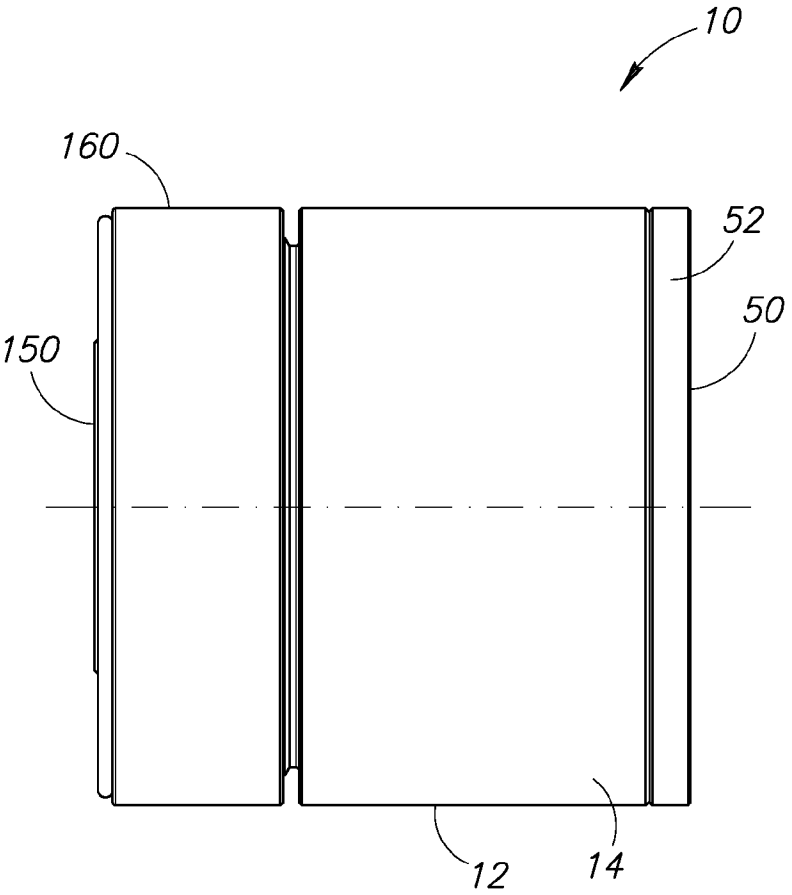
FIG. 9 is a side elevational view of the actuator of FIG. 7.
Figure 10:
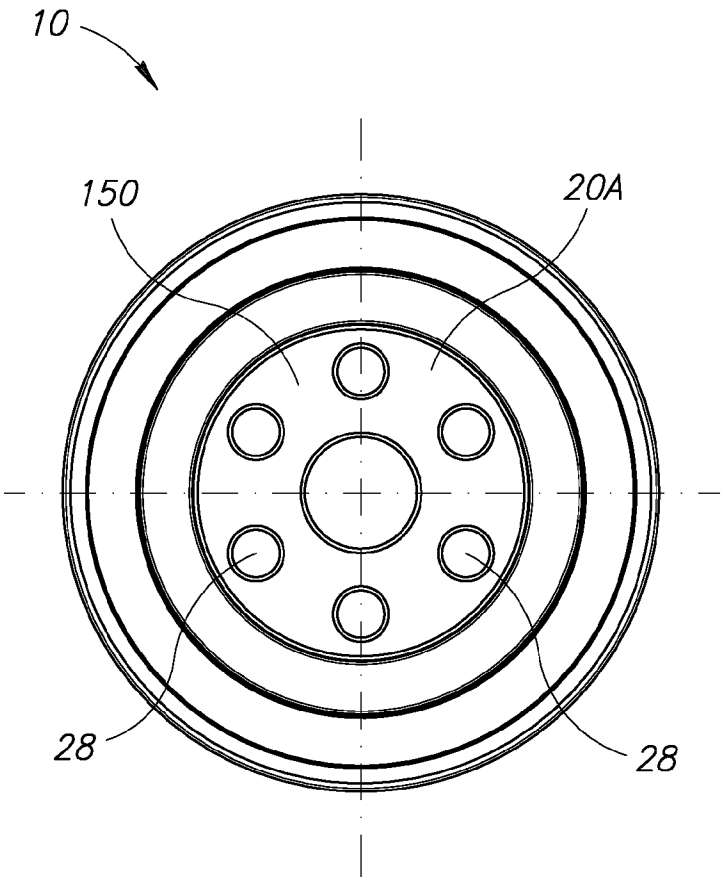
FIG. 10 is an end elevational view of the actuator of FIG. 7.

A fourth embodiment of the fluid-powered rotary actuator 10 of the present invention is shown in FIGS. 5 and 6. The actuator of this fourth embodiment has substantially the same basic design as the first and second embodiments so only the more significant difference will be described and the same reference numbering will be used for the same or similar component of the actuator.

The actuator 10 of the this fourth embodiment is configured for mounting the torque member flange portion 52 (connection member) of the torque member 50 to the structure 90 (i.e., the support structure for the actuator), rather than using mounting projections 92 of the body 12 as shown in the embodiments described above. In such manner, the operating torque of the actuator 10 is transmitted during fluid-powered operation of the actuator by the piston sleeve portion 74 of the piston sleeve 70 to the torque member central portion 60 located on the axis 21 of the actuator, interior of the annular piston sleeve, which transfers that torque via the torque member flange 52 directly to the structure 90 to which the actuator is mounted, rather than to the second body end 18 of the body 12 or any other portion of the body or body sidewall 14, thereby relieving the body of the requirement to handle the substantial torque resulting during fluid-powered operation of the actuator. This is accomplished by sizing the diameter of the torque member flange portion 52 to extend radially outward beyond the second body end wall 15E located at the second body end 18 to define a circumferentially extending attachment portion 126 which projects sufficiently outward beyond the second body end wall 15E to accommodate a plurality of circumferentially arranged apertures 128 (only two being illustrated in FIG. 5) for attaching the torque member flange portion 52 to the structure 90. A plurality of bolts 130 extend through the apertures 128 and are each threadably received in one of a plurality of circumferentially arranged apertures 132 in the structure 90, which are arranged to correspond in position with the apertures 128 in the torque member flange portion 52. Alternatively, the structure 90 may be provided with apertures 133 aligned with the apertures 54 of the torque member flange portion 54, and the bolts 56 used to attach the torque member flange portion 52 to the body 12 at the second body end 18 may be used to also attach the torque member flange portion 52 to the structure 90, with the bolts lengthened to accommodate for the thickness of the structure 90. Yet a second alternative manner of attaching the torque member flange portion 52 to the structure 90 is to provide the structure with a plurality of apertures 133A, shown radially inwardly located relative to the bolts 56, with a plurality of bolts 135 extend through the apertures 133A and each threadably received in one of a plurality of apertures 1338 in the torque member flange portion 52, which are arranged to correspond in position with the apertures 133A.

The shaft 20 of the actuator 10 of this fourth embodiment has a shaft flange portion 22 which does not extend radially outward of the inward portion of the body sidewall portion 15A. Further, the apertures 28 for attaching the shaft 20 to a structure are located axially inward of inward portion of the body sidewall portion 15A. The shaft 20 further includes a shaft rod 134 in coaxial alignment with the axis 21 of the body sidewall 14. A rod first end portion 136 of the rod 134 is rigidly connected to an axially inward end of the shaft first end portion 20A at the first body end 16 for rotation with the shaft first end portion 20A, and extends coaxially within the body 12 toward the second body end 18 through an aperture 138 in the end wall 78 of the interior piston sleeve chamber 76, and terminates in a rod second end portion 140 positioned within interior piston sleeve chamber 76, axially inward of the free end portion 64 of the torque member central portion 60. The rod 134 is rotatably disposed in the aperture 138 in the end wall 78 of the interior piston sleeve chamber 76, and rotates freely relative to the torque member 50. A seal 142 is provided to prevent passage of fluid between the rod 134 and the aperture 138.

The locations of the first port P1 and the second port P2 are changed to be in the shaft first end portion 20A, rather than in the mid-body sidewall portion 15C and the second body end sidewall portion 15B as with the embodiments described above. The first port P1 extends through the shaft first end portion 20A of the shaft 20, located toward the first body end 16, and is in fluid communication with the interior chamber 20B of the shaft portion 24, which is in fluid communication with the fluid-tight compartment portion 75A of the annular chamber 75 to a side of the piston head portion toward the first body end 16. The second port P2 extends through the shaft first end portion 20A of the shaft 20, located toward the first body end 16, and is in fluid communication with the interior piston sleeve chamber 76 of the piston sleeve 70 via a channel 144 axially extending through the rod 134 and terminating at the rod second end portion 140 positioned within the interior piston sleeve chamber 76, which is in fluid communication with the fluid-tight compartment portion 75B of the annular chamber 75 to a side of the piston head portion toward the second body end 18. It is understood that great flexibility exists to alter the locations of the first port P1 which supplies fluid to the fluid-tight compartment portion 75A of the annular chamber 75 and the second port P2 which supplies fluid to the fluid-tight compartment portion 75B of the annular chamber 75. Minor construction changes can be made to relocate the first and second ports P1 and P2 without departing from the spirit of the invention, whether the ports are in or attached to the body 12, the shaft 20 or the torque member 50.

It is to be understood that features and aspects of any one of the disclosed embodiments of the fluid-powered rotary actuator 10 may be used in others of the disclosed embodiments, alone or in combination with other features and aspects of different ones of the disclosed embodiments.

A fifth embodiment of the fluid-powered rotary actuator 10 of the present invention is shown in FIGS. 7-10. The actuator of this fifth embodiment has substantially the same basic design as the first embodiment so only the more significant difference will be described and the same reference numbering will be used for the same or similar component of the actuator.

The body 12 of the actuator 10 of the this fifth embodiment is design to have a shorter overall length. The body sidewall 14 and the shaft 20 are shortened. This is partly achieved by not using the body shoulders 14A and 14B or the ring member 36 to limit the axial movement of the shaft 20 within the body 20, as will be described below.

Also, in this fifth embodiment, the shaft 20 does not use the circumferentially extending shaft flange portion 22 positioned axially outward of the body 12 at the first body end for the location of the plurality of circumferentially arranged apertures 28 for attachment of the shaft to a structure to which the rotational drive of the actuator 10 is to be transmitted by the powered rotation of the shaft. Instead, the apertures 28 are located in a central shaft end wall portion 150. The shaft 20 has a shoulder portion 152 which extends circumferentially about the central shaft end wall portion 150 and is located axially inward of the central shaft end wall portion.

The torque member central portion 60 in this fifth embodiment extends along the longitudinal axis 21 of the body sidewall 14 to the shaft first end portion 20A at the first body end 16 and has its free end portion 64 adjacent to a recessed portion of an inward surface 154 of the central shaft end wall portion 150 to limit the axial movement of the shaft 20 within the body 12 toward the second body end 18. A thrust bearing 155 is positioned between the free end portion 64 of the torque member central portion 60 and the recessed portion of the inward surface 154 of the central shaft end wall portion 150. The free end portion 64 does not inhibit rotation of the shaft 20.

To reach the central shaft end wall portion 150, the free end portion 64 of the torque member central portion 60 passes through a central aperture 156 in the end wall 78 of the interior piston sleeve chamber 76. A seal 158 is provided to prevent passage of fluid between the free end portion 64 and the wall of the central aperture 156. The piston sleeve 70 is free to both move axially and rotate relative to at least one of the torque member 50 or the shaft 20.

An end cap 160 is position at the first body end 16 and has a central aperture 162 into which the central shaft end wall portion 150 projects. A seal 164 is provided to prevent passage of fluid between the central shaft end wall portion 150 and the wall of the central aperture 162. The first body end sidewall portion 15A of the body sidewall 14 has a threaded outward wall portion 166. The end cap 160 has a threaded inward wall portion 160A which is threadably received on the threaded outward wall portion 166 of the first body end sidewall portion 15A. An annular thrust bearing 168 is positioned between an inward wall (i.e., cap stop wall portion) of the end cap 160 and the shoulder portion 152 of the shaft 20 to facilitate sliding rotary motion. The end cap 160 limits movement of the shaft 20 within the body 20 toward the first body end. Bearings 170 and 172 are positioned between the inward wall of the sidewall 15A and the outward wall of the shaft 20 to transfer radial loads between the body 20 and the shaft.

The actuator 10 of the fifth embodiment is not illustrated with any particular mounting members by which the body 12 may be mounted to another structure either for support by the structure or for rotation of the structure. It may use the mounting projections 92 illustrated for the embodiment of FIG. 1, or any other manner of attachment.

This fifth embodiment utilizes first and second ports P1 and P2, as does the embodiment of FIG. 1, to cause movement of the piston sleeve 70, however, they are not illustrated in the drawings for the fifth embodiment. The fluid-powered operation of the actuator 10 of the fifth embodiment is the same as with the embodiment of FIG. 1.

It should be understood that the sliding bearings described above and shown in the drawings for all embodiments may be eliminated or replaced with rolling element type bearings.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered rotary actuator, comprising:

a body having a longitudinal axis, and first and second body end portions with a body sidewall extending therebetween, said body further including a mid-body portion positioned between said first and second body end portions, a first body stop portion at said first body end portion facing axially away from said second body end portion, and a second body stop portion at said mid-body portion facing axially away from said first body end portion;

a shaft rotatably and coaxially disposed within said body and extending along said axis from said first body end portion to a shaft end located toward said second body end portion, said shaft having an annular shaft portion with an inner shaft portion chamber, said shaft portion chamber having a shaft portion chamber opening at said shaft end, said shaft portion chamber extending from said shaft portion chamber opening toward said first body end portion, said shaft being held against axial movement within said body, said shaft having a first shaft stop portion positioned to engage said first body stop portion to limit axial movement of said shaft toward said second body end portion, and a second shaft stop portion positioned to engage said second body stop portion and limit axial movement of said shaft toward said first body end portion;

a central torque member coaxially disposed within said body and extending along said axis from said second body end portion to a torque member end located toward said first body end portion, said central torque member being held stationary relative to said body; and a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said force-converting member having an inner force-converting member chamber extending from a force-converting member chamber opening in said piston head portion, on a side thereof toward said second body end portion, toward said first body end portion and at least partially through said drive member portion, said drive member portion extending through said shaft portion chamber opening and into said shaft portion chamber and being in operational engagement with said shaft portion, and said central torque member extending through said force-converting member chamber opening and into said inner force-converting member chamber and being in operational engagement with said drive member portion, to translate axial movement of said piston head portion into clockwise and counterclockwise rotation of said shaft relative to said body during fluid-powered operation of the actuator without said force-converting member being in direct operational engagement with said body sidewall.

2. The rotary actuator of claim 1 further including a connection member attached to said central torque member and attached to said body at said second body end portion to transmit torque encountered by said central torque member to said second body end portion and hold said central torque member stationary relative to said body during fluid-powered operation of the actuator.

3. The rotary actuator of claim 2 wherein said connection member is an end flange closing a body end opening at said second body end portion.

4. The rotary actuator of claim 2 wherein said connection member is rigidly attached to said central torque member and removably attached to said second body end portion.

5. The rotary actuator of claim 1 for use with an external support member, further including a connection member attached to said central torque member and attachable to the support member for the transmission of torque experienced by said central torque member to the support member.

6. The rotary actuator of claim 5 wherein said connection member is attached to said body at said second body end portion to prevent relative rotational movement between said central torque member and said body during fluid-powered operation of the actuator.

7. The rotary actuator of claim 6 wherein said connection member has a first portion closing a body end opening at said second body end portion, and a second portion adapted for connection to the support member to hold said central torque member stationary relative to said body.

8. The rotary actuator of claim 1 wherein said drive member portion has outward grooves and said shaft portion has inward grooves, with said drive member portion outward grooves and said shaft portion inward grooves in operational engagement, and wherein said central torque member has outward grooves and said drive member portion has inward grooves, with said central torque member outward grooves and said drive member portion inward grooves in operational engagement.

9. The rotary actuator of claim 8 wherein said shaft portion inward grooves are positioned within said shaft portion chamber, and drive member portion inward grooves are positioned within said inner force-converting member chamber.

10. The rotary actuator of claim 1 wherein said inner force-converting member chamber has an end wall closing the end of said inner force-converting member chamber toward said first body end portion.

11. The rotary actuator of claim 1 wherein said second shaft stop portion is a ring member attached at said annular shaft portion at said shaft end.

12. The rotary actuator of claim 11 wherein said ring member is removably attached to said annular shaft portion at said shaft end.

13. The rotary actuator of claim 1 wherein said first and second body stop portions are shoulders on an interior surface of said body.

14. A fluid-powered rotary actuator, comprising:

a body having a longitudinal axis, and first and second body end portions with a body sidewall extending therebetween;

a shaft rotatably and coaxially disposed within said body and extending along said axis from said first body end portion to a shaft end located toward said second body end portion, said shaft having an annular shaft portion with an inner shaft portion chamber, said shaft portion chamber having a shaft portion chamber opening at said shaft end, said shaft portion chamber extending from said shaft portion chamber opening toward said first body end portion, said shaft being held against axial movement within said body;

a central torque member coaxially disposed within said body and extending along said axis from said second body end portion to a torque member end located toward said first body end portion, said central torque member being held stationary relative to said body;

a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said force-converting member having an inner force-converting member chamber extending from a force-converting member chamber opening in said piston head portion, on a side thereof toward said second body end portion, toward said first body end portion and at least partially through said drive member portion, said drive member portion extending through said shaft portion chamber opening and into said shaft portion chamber and being in operational engagement with said shaft portion, and said central torque member extending through said force-converting member chamber opening and into said inner force-converting member chamber and being in operational engagement with said drive member portion, to translate axial movement of said piston head portion into clockwise and counterclockwise rotation of said shaft relative to said body during fluid-powered operation of the actuator without said force-converting member being in direct operational engagement with said body sidewall; and an end cap attached to said body at said first body end portion, said end cap having a central cap opening therethrough and a cap stop wall portion, and wherein said shaft has a shaft end portion with a central shaft portion, an outward shaft stop wall portion and an inward shaft stop wall portion, said central shaft portion projecting away from said second body end portion and into said central cap opening, said outward shaft stop wall portion positioned adjacent to said cap stop wall portion to limit axial movement of said shaft toward said first body end portion, and wherein said inner force-converting member chamber has a force-converting member chamber end wall at an end of said inner force-converting member chamber toward said first body end portion with a central force-converting member chamber opening therethrough, said central torque member extending through said central force-converting member chamber opening and having said torque member end located adjacent to said inward shaft stop wall portion to limit axial movement of said shaft toward said second body end portion.

15. A fluid-powered rotary actuator, comprising:

a body having a longitudinal axis, and first and second body end portions with a body sidewall extending therebetween, said body further including a mid-body portion positioned between said first and second body end portions, a first body stop portion at said first body end portion facing axially away from said second body end portion, and a second body stop portion at said mid-body portion facing axially away from said first body end portion;

a shaft rotatably and coaxially disposed within said body and extending along said axis from said first body end portion to a shaft end located toward said second body end portion, said shaft having an annular shaft portion with an inner shaft portion chamber, said shaft portion chamber having a shaft portion chamber opening at said shaft end, said shaft portion chamber extending from said shaft portion chamber opening toward said first body end portion, said shaft being held against axial movement within said body, said shaft having a first shaft stop portion positioned to engage said first body stop portion to limit axial movement of said shaft toward said second body end portion, and a second shaft stop portion positioned to engage said second body stop portion and limit axial movement of said shaft toward said first body end portion;

a torque member having a central torque member portion and a torque member transfer portion, said central torque member portion coaxially disposed within said body and extending along said axis from said second body end portion to a torque member end located toward said first body end portion, said torque member transfer portion positioned axially outward of said body beyond said second body end portion and attached to said body at said second body end portion to transmit torque encountered by said central torque member portion to said second body end portion and to hold said central torque member portion stationary relative to said body during fluid-powered operation of the actuator; and a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said force-converting member having an inner force-converting member chamber extending from a force-converting member chamber opening in said piston head portion, on a side thereof toward said second body end portion, toward said first body end portion and at least partially through said drive member portion, said drive member portion extending through said shaft portion chamber opening and into said shaft portion chamber and being in operational engagement with said shaft portion, and said central torque member portion extending through said force-converting member chamber opening and into said inner force-converting member chamber and being in operational engagement with said drive member portion, to translate axial movement of said piston head portion into clockwise and counterclockwise rotation of said shaft relative to said body during fluid-powered operation of the actuator without said force-converting member being in direct operational engagement with said body sidewall.

16. The rotary actuator of claim 15 for use with an external support member, wherein said torque member transfer portion has an attachment portion adapted for connection to the support member to transmit torque experienced by said central torque member portion to the support member.

17. The rotary actuator of claim 15 wherein said drive member portion has outward grooves and said shaft portion has inward grooves, with said drive member portion outward grooves and said shaft portion inward grooves in operational engagement, and wherein said central torque member portion has outward grooves and said drive member portion has inward grooves, with said central torque member portion outward grooves and said drive member portion inward grooves in operational engagement.

18. The rotary actuator of claim 17 wherein said shaft portion inward grooves are positioned within said shaft portion chamber, and drive member portion inward grooves are positioned within said inner force-converting member chamber.

19. A fluid-powered rotary actuator, comprising:

a body having a longitudinal axis, and first and second body end portions with a body sidewall extending therebetween;

a shaft rotatably and coaxially disposed within said body and extending along said axis from said first body end portion to a shaft end located toward said second body end portion, said shaft having an annular shaft portion with an inner shaft portion chamber, said shaft portion chamber having a shaft portion chamber opening at said shaft end, said shaft portion chamber extending from said shaft portion chamber opening toward said first body end portion, said shaft being held against axial movement within said body;

a torque member having a central torque member portion and a torque member transfer portion, said central torque member portion coaxially disposed within said body and extending along said axis from said second body end portion to a torque member end located toward said first body end portion, said torque member transfer portion positioned axially outward of said body beyond said second body end portion and attached to said body at said second body end portion to transmit torque encountered by said central torque member portion to said second body end portion and to hold said central torque member portion stationary relative to said body during fluid-powered operation of the actuator;

a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said force-converting member having an inner force-converting member chamber extending from a force-converting member chamber opening in said piston head portion, on a side thereof toward said second body end portion, toward said first body end portion and at least partially through said drive member portion, said drive member portion extending through said shaft portion chamber opening and into said shaft portion chamber and being in operational engagement with said shaft portion, and said central torque member portion extending through said force-converting member chamber opening and into said inner force-converting member chamber and being in operational engagement with said drive member portion, to translate axial movement of said piston head portion into clockwise and counterclockwise rotation of said shaft relative to said body during fluid-powered operation of the actuator without said force-converting member being in direct operational engagement with said body sidewall; and an end cap attached to said body at said first body end portion, said end cap having a central cap opening therethrough and a cap stop wall portion, and wherein said shaft has a shaft end portion with a central shaft portion, an outward shaft stop wall portion and an inward shaft stop wall portion, said central shaft portion projecting away from said second body end portion and into said central cap opening, said outward shaft stop wall portion positioned adjacent to said cap stop wall portion to limit axial movement of said shaft toward said first body end portion, and wherein said inner force-converting member chamber has a force-converting member chamber end wall at an end of said inner force-converting member chamber toward said first body end portion with a central force-converting member chamber opening therethrough, said central torque member portion extending through said central force-converting member chamber opening and having said torque member end located adjacent to said inward shaft stop wall portion to limit axial movement of said shaft toward said second body end portion.

20. A fluid-powered rotary actuator, comprising:

a body having a longitudinal axis, and first and second body end portions with a body sidewall extending therebetween, said body further including a mid-body portion positioned between said first and second body end portions, a first body stop portion at said first body end portion facing axially away from said second body end portion, and a second body stop portion at said mid-body portion facing axially away from said first body end portion;

a shaft rotatably and coaxially disposed within said body and extending along said axis from said first body end portion to a shaft end located toward said second body end portion, said shaft having inward grooves, said shaft being held against axial movement within said body, said shaft having a first shaft stop portion positioned to engage said first body stop portion to limit axial movement of said shaft toward said second body end portion, and a second shaft stop portion positioned to engage said second body stop portion and limit axial movement of said shaft toward said first body end portion;

a central torque member coaxially disposed within said body and extending along said axis from said second body end portion to a torque member end located toward said first body end portion, said central torque member having outward grooves, said central torque member being held stationary relative to said body; and a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said drive member portion having outward grooves operatively engaging said inward grooves of said shaft, and said drive member portion having inward grooves operatively engaging said outward grooves of said central torque member, to translate axial movement of said piston head portion into clockwise and counterclockwise rotation of said shaft relative to said body during fluid-powered operation of the actuator.

21. The rotary actuator of claim 20 wherein said shaft has an inner shaft chamber with said drive member portion extending into said shaft chamber, and said force-converting member has an inner force-converting member chamber with said central torque member extending into said inner force-converting member chamber, said shaft inward grooves positioned within said shaft portion chamber, and drive member portion inward grooves positioned within said inner force-converting member chamber.

22. The rotary actuator of claim 20 wherein said inward grooves of said drive member portion operatively engage said outward grooves of said central torque member at a radial location radially inward of the radial location where said outward grooves of said drive member portion operatively engage said inward grooves of said shaft.

23. The rotary actuator of claim 20 further including a torque transfer member attached to said central torque member and attached to said body at said second body end portion to transmit torque encountered by said central torque member to said second body end portion and hold said central torque member stationary relative to said body during fluid-powered operation of the actuator without said force-converting member being in direct operational engagement with said body sidewall.

24. The rotary actuator of claim 20 for use with an external support member, further including a torque transfer member attached to said central torque member and attachable to the support member for the transmission of torque experienced by said central torque member to the support member.

25. The rotary actuator of claim 24 wherein said torque transfer member is attached to said body at said second body end portion to prevent relative rotational movement between said central torque member and said body during fluid-powered operation of the actuator.

26. The rotary actuator of claim 20 wherein said second shaft stop portion is a ring member attached at said annular shaft portion at said shaft end.

27. The rotary actuator of claim 20 wherein said first and second body stop portions are shoulders on an interior surface of said body.

28. A fluid-powered rotary actuator, comprising:

a body having a longitudinal axis, and first and second body end portions with a body sidewall extending therebetween;

a shaft rotatably and coaxially disposed within said body and extending along said axis from said first body end portion to a shaft end located toward said second body end portion, said shaft having inward grooves, said shaft being held against axial movement within said body;

a central torque member coaxially disposed within said body and extending along said axis from said second body end portion to a torque member end located toward said first body end portion, said central torque member having outward grooves, said central torque member being held stationary relative to said body;

a linear-to-rotary force-converting member disposed coaxially within said body and mounted for axial movement within said body in response to the selective application of pressurized fluid thereto, said force-converting member having an annular piston head portion located between said shaft end and said second body end portion and an annular drive member portion extending along said axis from said piston head portion toward said first body end portion, said drive member portion having outward grooves operatively engaging said inward grooves of said shaft, and said drive member portion having inward grooves operatively engaging said outward grooves of said central torque member, to translate axial movement of said piston head portion into clockwise and counterclockwise rotation of said shaft relative to said body during fluid-powered operation of the actuator; and an end cap attached to said body at said first body end portion, said end cap having a central cap opening therethrough and a cap stop wall portion, and wherein said shaft has a shaft end portion with a central shaft portion, an outward shaft stop wall portion and an inward shaft stop wall portion, said central shaft portion projecting away from said second body end portion and into said central cap opening, said outward shaft stop wall portion positioned adjacent to said cap stop wall portion to limit axial movement of said shaft toward said first body end portion, and wherein said central torque member end positioned adjacent to said inward shaft stop wall portion to limit axial movement of said shaft toward said second body end portion.

* * * * *